United States Patent [19]

MacKay

[11] 4,106,116

[45] Aug. 8, 1978

[54] DISPERSING APPARATUS

[76] Inventor: Malcolm H. MacKay, 140 French Lea Rd., West Seneca, N.Y. 14224

[21] Appl. No.: 757,737

[22] Filed: Jan. 7, 1977

[51] Int. Cl.[2] ..... B01F 7/26; B01F 15/02

[52] U.S. Cl. ..... 366/144; 366/195; 366/196; 366/315

[58] Field of Search ..... 259/7, 8, 5, 6, 21, 259/22, 23, 24, 42, 43, 44, 65, 66, 106, 107, 108, 121, 122

[56] References Cited

U.S. PATENT DOCUMENTS

| | | | |
|---|---|---|---|
| 2,855,156 | 10/1958 | Hochberg | 259/8 |
| 3,013,866 | 12/1961 | Samaniego | 259/8 |
| 3,134,549 | 5/1964 | Quackenbush | 259/8 |
| 3,243,128 | 3/1966 | Tight | 259/7 |
| 3,508,882 | 4/1970 | Farnell | 259/8 |
| 3,607,124 | 9/1971 | Zippel | 259/8 |

*Primary Examiner*—Robert W. Jenkins
*Attorney, Agent, or Firm*—Raymond F. Kramer

[57] ABSTRACT

An apparatus of the shot mill type includes a substantially vertical vessel, preferably cylindrical, containing shot for use as a dispersing media (also useful for deagglomerating and size-reducing material being dispersed), a bottom inlet for a mixture of particulate material to be dispersed and liquid vehicle for it, and a top outlet, a substantially vertical and axially rotatable agitator and a stationary screen in the vessel at the top thereof through which the dispersed material passes and through which the dispersing media does not pass. In preferred embodiments of the invention the pressure at the top of the vessel is kept low so as to obviate pressure sealing, the inlet includes a removable sacrificial fitting in a side wall of the vessel near the bottom, the vessel walls and bottom are jacketed for temperature control, a washing screen is present at the top circumferential portion of the vessel to facilitate removal of undersized media during washing, the vessel bottom includes a screened outlet to allow selective removal of particulate material and vehicle, or media and to facilitate washing of the vessel, means are provided on the shaft near the screen for preventing buildup of particulate material and sealing is effected between the rotating shaft and stationary screen by means of a bearing on the shaft and a bushing held to a screen holder, both bearing and bushing being of a hard material, such as tungsten carbide.

22 Claims, 4 Drawing Figures

DISPERSING APPARATUS

This invention is of a dispersing apparatus, suitable for dispersing particulate solid material in a liquid vehicle by means of agitated dispersing media. More particularly, it relates to an apparatus of the type sometimes referred to as a shot mill, in which steel shot, glass balls, sand or other material of a size greater than the particulate material to be dispersed, deagglomerated or size-reduced, is agitated in a vessel and by repeated contact with the particulate material in the liquid vehicle, disperses, deagglomerates and/or size-reduces it.

Shot mills have been employed extensively for dispersing, deagglomerating and size-reducing various particulate materials in liquid vehicles. They are especially useful for deagglomerating and dispersing solid particles, such as insoluble pigments, in liquid vehicles, such as water. In most of such apparatuses a charge of media, such as steel shot or other material of greater strength and density than the particles to be dispersed, is agitated in a vertical cylindrical vessel so that at least a part thereof rises up in the vessel to some extent and continuously contacts a charge of a mixture of the particulate material to be dispersed and its vehicle, so that such material is subjected to dispersing, deagglomerating or size-reducing forces between media elements or between such elements and the vessel or agitator. The particulate material, when of desired small size, is removed from the vessel after passing through a screen which prevents the exit of oversized particles and media.

Many of the shot mills that have been marketed include peripheral or circumferential screens at the top of the vessel but these are disadvantageous because they tend to become worn by the media and also may be blocked by the media to an undesirable extent, decreasing mill throughput and often raising the internal pressure. U.S. Pat. Nos. 2,855,156; 3,134,549; 3,243,128; 3,352,501; 3,640,476; and 3,685,749 are illustrative of such apparatuses. To obviate the disadvantages of the circumferential or peripheral screen mills, mills with internal rotating screens held to rotating agitator shafts have been suggested and manufactured. Mills incorporating such feature are disclosed in U.S. Pat. Nos. 3,653,600; 3,802,633; and 3,844,490. However, such mills, while not subject to the disabilities of the circumferential screen-equipped mills, do possess other faults under various operating conditions. For example, when the dispersion being processed is very viscous and the mill becomes blocked for some reason, the rotating screen can become badly worn due to repeated contacts with particulate material and media about it. The rotating screen may also act as an agitator element, promoting the lifting of the media into the zone about it, which is often undesirable. Furthermore, media tends to be caught between seal elements at the top of the rotating screens a startup and shutdown, due to bearing play, and such can wear away gap seals, especially those made of ordinary sealing materials. Such mentioned problems are obviated or significantly ameliorated by use of the apparatus of this invention. These and various other deficiencies of both types of prior art mills mentioned are obviated by use of the apparatus of this invention.

In accordance with the present invention an apparatus for continuously dispersing a particulate solid material in a liquid vehicle by means of a dispersing media comprises a substantially vertical vessel having an inlet for a mixture of such particulate material and the liquid vehicle in which it is to be dispersed at the bottom thereof and an outlet for such particulate material dispersed in the liquid vehicle at the top thereof, an agitator having a substantially vertical shaft which rotates about a substantially vertical axis and which agitates the particulate solid material, the liquid vehicle therefor and the media to break up any agglomerates of the particulate material and to disperse such material in the liquid vehicle and a stationary screen in the vessel at an inner top location thereof through which the dispersion of particulate material in liquid vehicle therefor must pass to exit from the vessel through the outlet thereof. In a broader aspect of the invention an apparatus for continuously dispersing a particulate solid material in a liquid vehicle by means of a dispersing media comprises a vessel having an inlet for a mixture of such particulate material and the liquid vehicle in which it is to be dispersed and an outlet for such particulate material dispersed in the liquid vehicle, an agitator for agitating the particulate solid material, the liquid vehicle therefor and the media to break up any agglomerates of the particulate material and to disperse such material in the liquid vehicle and a stationary screen in the vessel at an inner location at an end thereof through which the dispersion of the particulate material in liquid vehicle therefor must pass to exit from the vessel through the outlet thereof and through which the media cannot pass. In preferred embodiments of the invention the vessel and the stationary screen are of vertical cylindrical shapes, the shaft of the agitator and the screen are vertical and coaxial with the vessel and the agitator shaft passes through the screen cylinder, with the openings of the screen being of such size as to pass the dispersion of particulate material and liquid vehicle and to bar passage of the dispersing media. In other aspects of the invention means are provided to limit the pressure in the vessel at the outlet; to assist in preventing buildup of particulate material inside the screen near the shaft; and to remove undersized media particles during a washing operation. Also within the invention is a sacrificial inlet fitting, which, when worn, may be replaced, thereby saving the vessel wall; and a combination of a bearing and a bushing, both of hard material, such as tungsten carbide, to maintain the trueness of rotation of the agitator shaft and to prevent media or oversized particles of product from exiting from the mill without passing through the internal screen.

The invention will be readily understood by reference to this specification and subsequent description, taken in conjunction with the drawing, in which.

Figure 1:
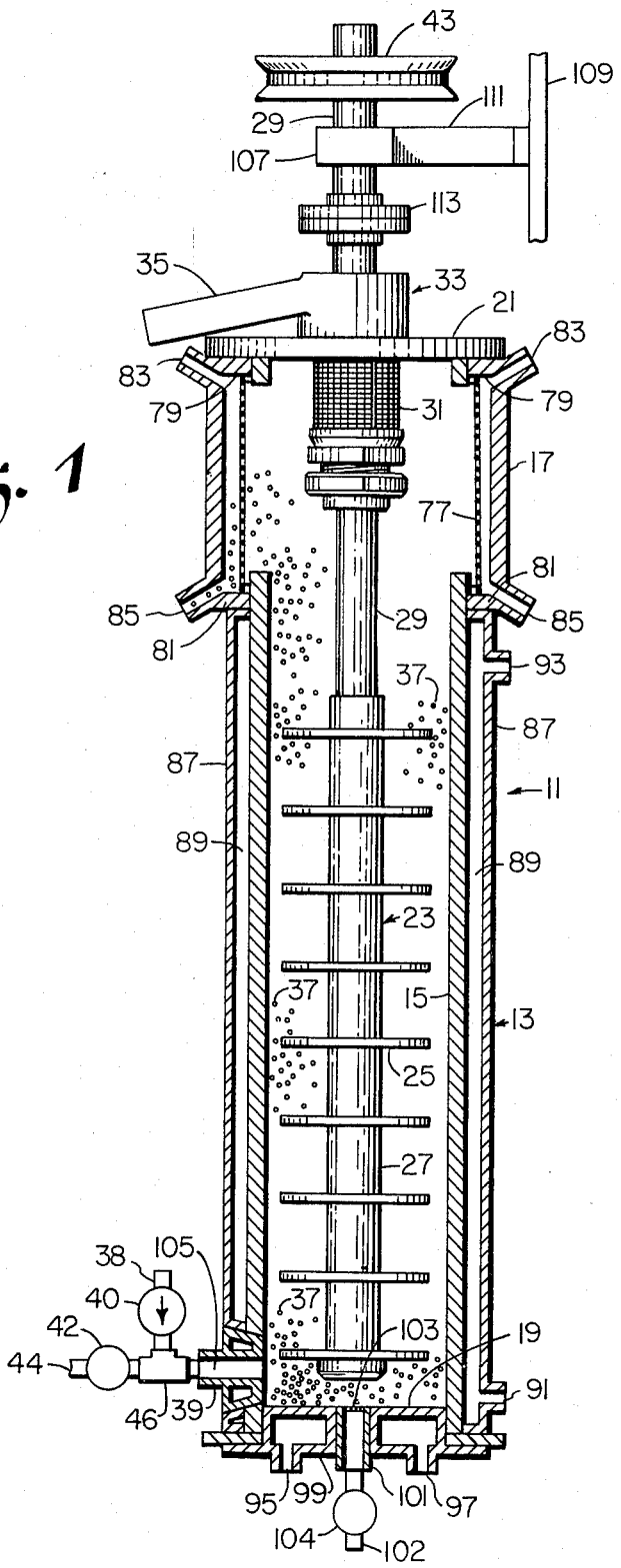
FIG. 1 is a partially centrally sectioned elevational view of a dispersing, deagglomerating and size-reducing apparatus of this invention.

Referring to FIG'S. 1 and 2, there is shown a preferred mill 11 of the invention equipped with a discharge trough, the top of which is open to the atmosphere, which includes a substantially vertical vessel 13, preferably vertical, cylindrical in shape, with cylindrical wall 15 (wall portion 17 may be considered as an extension thereof), bottom 19, top 21, agitator 23, comprising agitating discs 25 and separating collars 27 mounted on shaft 29 so as to rotate with it, and internal cylindrical stationary screen 31, mounted at the top of the apparatus, through which screen the dispersion of particulate material being processed and a vehicle for it pass via exit passageway 51 to trough 33, which has a discharge spout 35. Inside the mill, media 37, only some of which are shown, impinge on the rotating discs 25 or other suitable agitating elements of such general type and are moved outwardly by centrifugal force and upwardly by a combination of forces generated on impingement against the moving shaft, collars or agitators and the general movement of product upwardly in the mill. The product is pumped into the mill through inlet 39, which will be described in more detail later, by means of a variable speed positive displacement pump of conventional design, not illustrated, but other suitable pumping means may also be employed. Between the pump and the inlet there is located in line 38 a check valve 40, of conventional design, to prevent discharge of particulate material and vehicle (and media) from the vessel when the pump is not operating and in line 38 and upstream of the check valve there is also employed a conventional globe or gate valve, not shown, or other suitable valve for opening or closing the passageway from the pump to the vessel or adjusting it, as desired. Additionally, there will also usually be utilized a conventional globe or gate valve or other suitable valve 42 in line 44, through which media may also be added or removed via inlet 39. Such valves and T-fitting 46, on which they may be mounted or to which they are connected, as shown in the drawing, are illustrated because they are important auxiliary parts useful in operation of the apparatus but they should not be considered to be essential elements of the invention. Shaft 29, and through it, agitator 23, are rotated by an adjustable drive, not illustrated, connected by a drive belt, not illustrated, to pulley 43, which is held to shaft 29.

Figure 2:
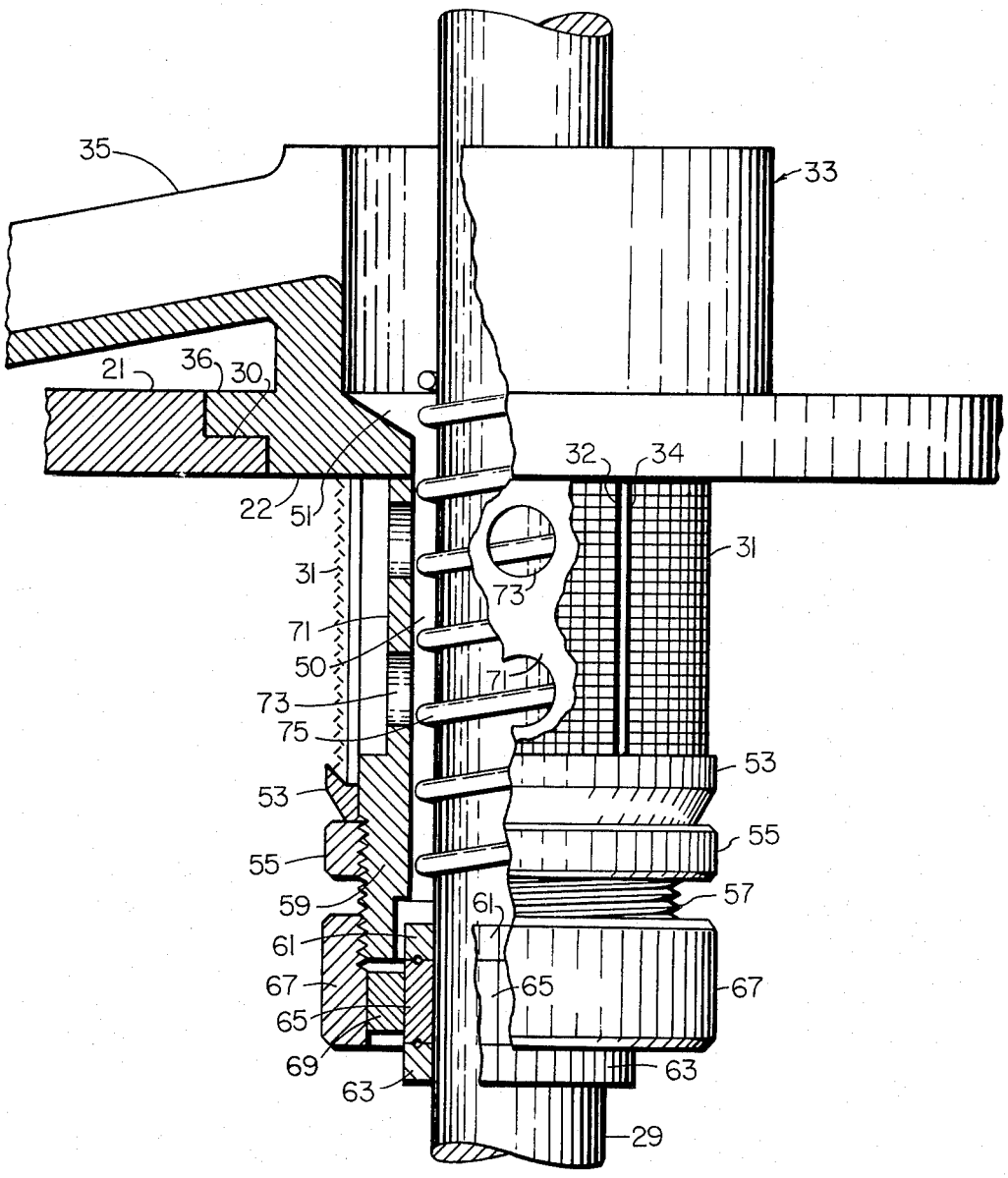
FIG. 2 is an enlarged, partially centrally sectioned and partially cut away view of a portion of the apparatus of FIG. 1.
Figure 4:
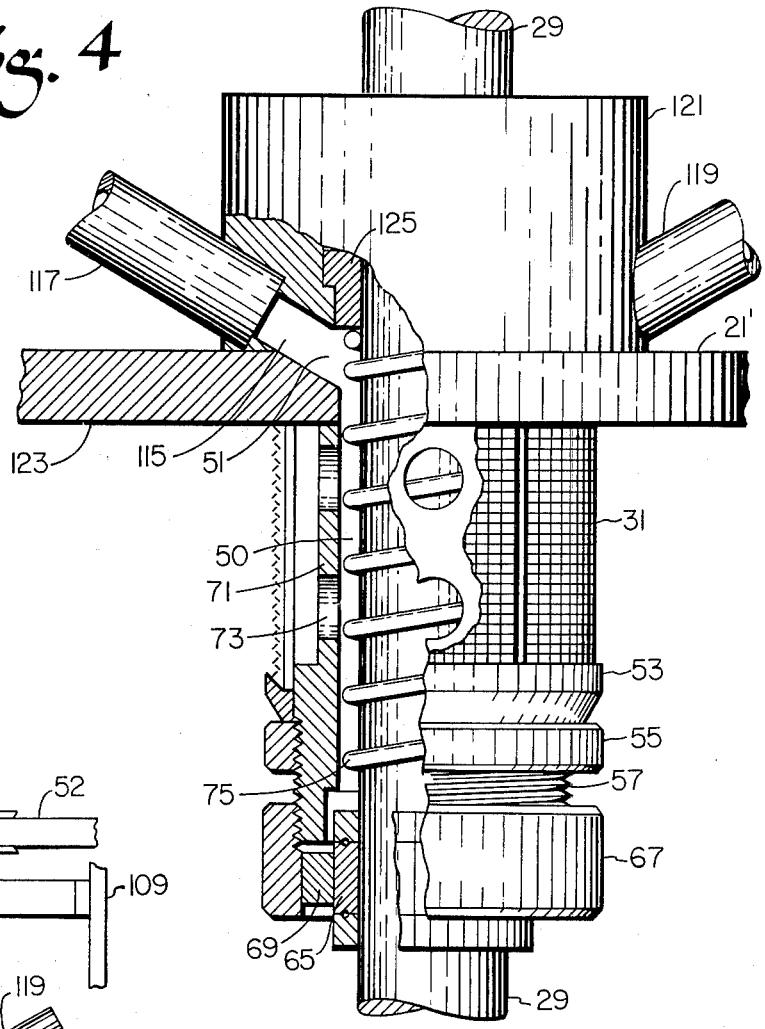
FIG. 4 is an enlarged, partially centrally sectioned and partially cut away view of a portion of the apparatus of FIG. 3.

The construction of the stationary internal screen 31 and its location and mounting, which are important aspects of the present invention, are best illustrated in FIG. 2. In such figure screen 31 is held in position coaxial with shaft 29 by screen retainer, holder or collar 53 which is held in place by threaded collar or retainer locknut 55, screwed onto thread 57 of lower bearing housing 59. Lower bearing retainer 61 and lower bearing holder 63 hold hard surfaced bearing 65 in rotating position on shaft 29 and bearing bushing holder 67 holds bushing 69 of hard material against bearing 65 by screwing onto threads 57 of bearing holder 59. Thus, the close contact between bearing 65 and bushing 69 prevents passage of particulate material or media between them and out through exit passageway 51 in such manner as to bypass screen 31 and the bearings maintain the shaft alignment. As illustrated, the part identified as bearing holder 59 is extended upwardly and is joined to vessel top 21 by any suitable means, such as the bottom 22 of trough 33. Bearing holder 59 includes wall portion 71 having openings 73 therein, through which screened material may pass to exit 51. Helical screw thread 75, shown as a helical spring, or other such suitable means, on shaft 29, acts to help lift or pump screened vehicle-particulate material mixture, which may be in the form of a slurry or paste, and helps to move it toward outlet 51 via clearance 50. The shaft turns in a clockwise direction, viewed from the top. It is an important aspect of this invention that the helical thread or equivalent means be on the shaft to help to break up any gel, paste or other deposit of particulate material, thereby preventing such particulate material buildup and facilitating cleaning of the mill. In other embodiments of the invention the wall 71 may be closer to the screen and the helical thread or spring height may be increased accordingly at appropriate locations so as to further assist in lifting the product and clearing the screen, in addition to preventing depositing of product. However, in the embodiment illustrated, in addition to lifting product and preventing depositing of particulate material, the helical spring does aid in cleaning the screen by drawing product through it. Note that the clearance between the spring and the bearing support wall 71 will be minimal, usually being less than 2 mm. and preferably less than 1 mm. Such clearances may also be employed when the screen, sufficiently strong to be form retaining, is employed without interposing of wall 71 and other means are provided to mount the screen 31, bearing 65 and bushing 69, or the screen is the bearing housing.

The screen illustrated is in two pieces, divided along edges 32 and 34 and similar edges 180° apart into two halves, but may be of other numbers of components. It is held in operating position by screen retainer 53 which is raised by retainer locknut 55 and forced upwardly, trapping screen 31 between the retainer and the mill cover. Although not shown, in one embodiment the screen is forced against a guide groove in said cover. Screen sides 32 and 34 are machined to fit with a clearance between them which is no greater than the screen opening. Instead of the split screen there may be used a continuous screen or one which is flexible and split only along one line of division. The screen may be removed through the vessel top after removal of the cover 21 and trough 33 or it may be disassembled and taken out of the vessel sidewardly after removal of split portion 17 and outer screen 77.

Referring again to FIG. 1, it is seen that screen 77 is held to flanges 79 and 81 of wall portion 17. The screen has openings therein of a size larger than that of the openings in screen 31 and smaller than that of correctly sized media. Usually the area of the individual openings in screen 77 will be at least 25% greater than such areas of the openings in screen 31 and preferably 50% greater. Wall section 17 will have upper and lower exits 83 and 85, respectively, so that during a washing operation, in which water or other washing liquid is forced through the mill (at much higher velocity than during dispersing, deagglomerating and milling) usually with the agitators running, undersized media will pass through the openings in screen 77 and out lower passages 85, together with some washing liquid, and additional washing liquid will exit through openings 83. Of course, in normal operation of the mill (not during washing) valves, not illustrated, in the appropriate lines, will prevent discharge of materials through openings 83 and 85 and such valves will be selectively opened, when desired to permit the discharge of undersized media and/or washing liquid during washing operations and when undersized media are to be removed. To make the apparatus adaptable for use with different particulate materials and media, screen 77 may be removable (as previously described for screen 31, or in other manner) so as to facilitate replacement with other such screens of different sizes.

Cylindrical vessel 13 includes vessel internal wall 15 and external or jacket wall 87, forming a jacket, through the interior 89 of which fluid, preferably liquid, may be circulated to help control the temperature of the contents of the mill. Fluid inlet 91 and outlet 93 are provided in the jacket wall. Although not illustrated, wall 17 may be similarly jacketed. Bottom 19 is also shown jacketed, with passageways 95 and 97 in jacket wall 99 being provided for the circulation of heat exchange fluid. Top 21 may be similarly jacketed but such is not illustrated.

In bottom 19 there is provided a screened liquid drain fitting 101 in which screen 103 has openings therein of such a size that the media will not pass through but the particulate material of such a size as to be satisfactorily dispersed in the liquid will. Drain fitting 101 is removable so as to permit discharge of media through the remaining passage (after removal of the fitting) when desired and similarly screen 103 is removable as shown. Fitting 101 is connected to washing line 102 which will direct washing liquid through valve 104 and upwardly through the mill to facilitate carrying out through screen 77 of undersized media particles. In addition to fitting 101 and the corresponding opening therein being provided for passage of washing water into the mill, such water may also be added through fitting 39, the combination of both openings allowing a desired greater volume of wash water to be passed through the mill so as better to carry the media upwardly to the screen. Fitting 39 is illustrated as a tapered plug with opening or passage 105 therein, through which particulate material, vehicle and media may be added to the mill. Because constant impingement of media against any irregular section of the mill wall, such as the edges of plug 39 near opening 105 and the interior of the mill, causes wear at such points, a replaceable plug of the type illustrated is highly advantageous. In the absence of such a plug, it may be necessary to replace a whole mill wall due to erosion by the media of the wall edge about an entrance passageway, especially at a lower part of the vessel wall where the media is usually more concentrated. Although the plug illustrated is of a tapered wall design, which is preferable in some applications, it is also within the invention and often preferable to utilize straight walled designs, preferably of substantially square or rounded corner square cross-section.

At the top of the mill spouted trough member 33 includes flange 36 for joinder to flange 30 of top 21 but the trough may be made integral with said top or may be constructed of other suitable designs, too. Desirably, as illustrated in FIG. 1, trough discharge spout 35 projects beyond the walls of the mixing or milling vessel jacket wall 87 and upper wall 17 for suitable discharge into a tank, pump inlet line or other such vessel or transporting means. Because the trough is relatively shallow the pressure at the vessel outlet, exit 51, will be low, less than 0.2 kg./sq. cm. gauge and preferably less than 0.1 kg./sq. cm. gauge. Such relatively low pressure will also preferably prevail in clearance 50 and at the lowermost part of screen 31 at both the interior and exterior thereof. Thus, it is not necessary to employ expensive pressure seals to keep the product from leaking out of the vessel or between bearings where the shaft enters the vessel or communicates with the interior thereof and at the same time a closed mill is obtained from which air is readily automatically vented, so that no air or gas vortex is produced at the top of the mill which would interfere with screening, lower throughput and sometimes adversely affect the product being processed.

In FIG. 1 one means of connecting the agitator shaft to a variable speed drive is illustrated but it is understood that various other types of drive mechanisms and connections may also be employed. Pulley 43 is connected by a belt to any of a plurality of other differently sized pulleys, a cone pulley or other speed modifying means, not shown. Thus, the rotational speed of shaft 29 can be adjusted, as desired, to obtain the optimum distribution of media 37 through the mill to effect best deagglomeration, dispersion or milling of the particulate material in the vehicle, both of which are also in the mill but are not illustrated. Pillow block 107 is held to machine frame 109 by mounting means 111 and maintains the trueness of rotation of the shaft and the mounted agitator discs. Normally, an electric motor, preferably explosion proof, plus speed changing means will also be mounted on frame 109 but they are not illustrated herein because they are not primary parts of the present apparatus. Parts of shaft 29 are joined together by separable coupling means 113 so that, if desired, the mill and the drive shaft therein may be separated from the driving means. Thus, especially when the mill is supported by rollers, not illustrated, it may be rolled out from under the driving means when repairs are neccesitated and top 21 and associated parts may be removed, as may be the rest of the shaft, screen, agitators, etc. Of course, access to the interior of the apparatus may also be obtained through the bottom by removal of drain fitting 101 or by removal of the bottom itself and access to the upper portion of the mill interior may be obtained by removal of side wall section 17 and screens 77 and 31.

Figure 3:
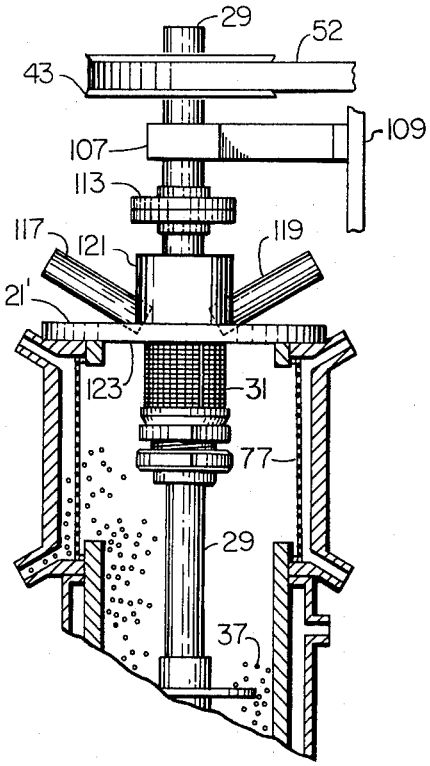
FIG. 3 is a partially centrally sectioned elevational view of an upper portion of a modified embodiment of the invention.

An alternative embodiment of the invention, illustrated in FIG.'S. 3 and 4, is essentially the same as that of FIG'S. 1 and 2, with the exception that instead of the trough open to the atmosphere the upper portion of the mill includes two exit passageways which may be considered to be extensions of passageways 51. Both of such exit passageways further communicate with exit pipes, so that, if desired, the product being discharged may be kept out of contact with the air and in some cases may be maintained under pressure. (Of course, the trough of FIG'S. 1 and 2 may be loosely covered to prevent contamination of the product by air or substances in the air). Passageway 115 communicates with exit passageway 51 and outlet pipe 117 and a corresponding passageway communicates with outlet 119. Either or both outlets may be employed at one time and valves, not shown, are provided to direct the exiting material accordingly. Pipes 117 and 119 are joined to mounting unit 121 which is held to inner top section 123 which, in turn, is joined to top 21. Mount 121 includes seal 125 for preventing discharge of processed material upwardly along shaft 29. Such seal may be a pressure seal, if desired, and such seals are normally employed when lines 117 and 119 are directed upwardly so that the processed material has to be raised to substantial heights or when, for other reasons, pressure is developed in such discharge pipes. However, it is preferred that the height to which the discharged material is raised should be less than 2 meters above the mill and the exit therefrom, preferably under 1 meter, so the pressure is less than 0.2 kg./sq. cm. gauge and preferably less than 0.1 kg./sq. cm. g. In FIG. 3, belt 52 is shown driving pulley 43. Also, in FIG'S. 3 and 4 top 21' corresponds to top 21 of FIG'S. 1 and 2.

Various modifications may be made in the apparatuses illustrated. Thus, for example, to limit the travel of media into the upper section of the mill, near the screens, instead of the mill shape being cylindrical it may be a surface of revolution about the vertical axis which is curved in central sectional elevational view, with the narrower portion of the curve at the upper part of the mill. To obtain improved mixing in particular milling applications the discs may be replaced by other agitating elements mounted on the central shaft, such as those of U.S. Pat. Nos. 2,855,156; 3,234,549; and 3,685,749 and the distances between the agitating elements may be altered so as to place them closer together near the bottom of the mill and farther apart near the top.

The materials of construction employed for making the present apparatuses are standard and are readily available. Of course, they will be selected so as to be compatible with the materials being processed and the media being employed. For example, while cold rolled steel may be utilized for almost all the parts, except the particularly hard bearing-bushing members and springs, it may sometimes be desirable to employ stainless steels (including stainless steel springs) and tungsten carbide or similar hard materials should be used for any bearing-bushing members which are to be maintained in good sealing contact. Stainless steel screens are often best.

The present mills may be made of a wide variety of sizes, normally being of heights in the range of 0.2 m. to 10 m., with capacities from one liter to 10,000 liters. The mills may be employed to disperse, deagglomerate and size reduce various types of insoluble particulate materials, such as varnishes, waxes, polymers, resins, pigments, plasticizers and inks in both aqueous media, such as water, and non-aqueous media, such as ethanol, chlorinated lower hydrocarbons and other lipophilic solvents and dispersants. The media employed may be steel shot, sand, procelain balls, steel balls or any other suitable solid material of greater "strength" than the particulate material being deagglomerated, dispersed or size-reduced. The mixture of particulate material and vehicle is normally forced through the invented apparatus by a positive displacement pump and the temperature of the materials in the apparatus may be from ambient, e.g., 20° C., to as high as 120° C., depending on the boiling point of the vehicle and the temperatures at which the materials being processed are stable. Cooling fluid, preferably cooling water, may be pumped through the various jackets to maintain such desired temperature. The viscosity of the mixture of particulate material and vehicle being fed to the apparatus may be any suitable viscosity, over a wide range, such as from 200 centipoises to over 60,000 centipoises but normally will be in the range of 500 to 60,000 centipoises, preferably 500 to 2,000 centipoises. The viscosity measurements given are Brookfield viscosities, measured at the temperature of operation. The particle sizes of the material leaving the apparatus will usually be from 0.5 to 500 microns, preferably 5 to 40 microns and the particle sizes of the media will normally be at least three times the diameter of the desired product and preferably at least ten times such diameter, e.g., 0.2 mm. to 5 mm., preferably 0.3 to 2 mm. Thus, should the media become fractured or worn away during use there is a sufficiently great safety factor provided to prevent such fractured media from exiting with the product through the screen provided, the openings of which are such as to prevent discharge of oversized product. Also, the clearance allowed between the bushing-bearing combination prevents leakage of material into the screened interior. The clearance should be less than 0.1 mm. between bearing and bushing faces and preferably from 0.02 to 0.07 mm. so as to prevent any undersized media from entering such clearance and to minimize the presence of any particulate material being treated from entering it, much less passing through it. The rate of passage of material through the mill (or holdup time) may be from one minute to one hour but is normally from 3 to 20 minutes, depending on the material being processed. Thus, when carbon black is deagglomerated and dispersed in water or a resin, usually without milling or size reduction, the dwell time may be in the lower portion of the range given whereas when dyestuffs or pigments are also being size-reduced, while being deagglomerated and dispersed, greater dwell times may be desirable.

In operation, using a mill of preferred size, like that of FIG'S. 1 and 2 (or 3 and 4) with a height of about two meters and with parts thereof being proportioned like those in the drawing, the mill is first filled with media, such as steel balls, to about 30 to 70%, preferably 50 to 70% of the height to the topmost agitating rotor or disc (because the spheres are of about half the volume, the media take up about 15 to 35%, preferably 25 to 35% of the volume of the vessel up to the height of such disc). Addition of media at startup is usually through the top or a side near the top of the apparatus but during use additional media may be added through inlet 105. After assembly of the mill is completed and all systems therein are operative, such as the cooling water jacket systems and product removal mechanisms, with shaft 29 turning at the desired speed (or initially slower) particulate material in the vehicle is pumped into the vessel by a variable speed positive displacement pump through check valve 40 and inlet 105 at the desired flow rate to obtain the correct dispersion and milling effects. The product is removed through trough 35, when the embodiment of FIG'S. 1 and 2 is employed and through either of outlet pipes 117 and 119 when the embodiment of FIG'S. 3 and 4 is used.

If it is desired to change the screen size and screen 31 has to be replaced it is a simple matter to remove upper side portion 17 and outer screen 77 and replace screen 31 without removing top 21. Alternatively, the top may be pulled. Of course, screen 77 can be changed in a similar manner.

After use of the apparatus it may be drained of vehicle and particulate material by opening of valve 104 and allowing a mixture of the vehicle and particles to pass out pipe 102. Such drainage is preferably effected while agitator 23 is inoperative or turned at a fairly slow speed and most of the time a valuable product may be removed and saved by this method. The remainder may be washed out of the mill by directing a solvent, such as water, into the mill through fittings 101 and 109. The combination action gives the water a swirling and lifting effect, especially useful to clean out the product from the bottom of the mill, wherein the media is most highly concentrated, and the solvent flow created has a sufficiently great vertical component, with the combined volumes of solvent being added to the mill, to lift undersized media to the region about screen 77 and permit it to be carried out through outlet 85, with additional water exiting through outlet 83. After any undersized media has been removed (it was still too large to pass through screen 31) and the mill has been cleaned a different charge may be added without fear of contamination. During both the dispersing and washing operations the temperature and pressure in the mill may be observed by using a thermometer and pressure gauge, not shown, usually inserted through a special opening in top 21, not shown, but also positionable at other locations.

A mill of the structure described possesses many advantages over mills of the prior art intended for substantially the same purpose. First of all, because the screen is in the interior of the mill it does not take a pounding from the media constantly striking it and does not tend to be plugged as readily. Because it is stationary there is less chance of leakage of material along the shaft through the top of the apparatus and there is less chance for media to become trapped and crushed between sealing members supporting the rotating screen, which problem is especially acute when starting up and turning off the agitator. Compared to mills with horizontal screens at the top thereof the present mills give a significantly greater screen area for passage of the product of desired size and have a lesser tendency to become clogged, which tendency is further diminished by the use of the helical spring or other shaft operated pumping and circulating means. Even if the present mill were intentionally to be operated under pressure, with pressure seals on the shaft, as when the material would be raised substantial heights above the mill, overpressures would not be obtained and hence the seals could be set without over-pressurization or under-pressurization thereof.

Should it be desired to change the media after washing, it is a simple matter to drop it through the main bottom opening into which fitting 101 is normally inserted, by merely removing the fitting. Then, screen 103 may be changed, if the media size is to be changed. If check valve 40 becomes jammed, because fitting 39 is inserted in the side of the vessel the check valve is readily accessible whereas if located under the vessel access would often be more difficult.

Although it is not contemplated that spring 75 will have to be removed, if this is to be done to thorougly clean out the apparatus it may be done by slightly compressing the spring and lifting it up along the shaft to remove it. Of course, initial installation is similarly effected. Yet, other types of elevating mechanisms differently joined to the shaft may also be employed. As shown, the spring tends to remain in position or ride up the shaft (due to its being a right hand spring with the shaft rotating clockwise viewed from the top) and so does not work loose. The various screens may be hinged together at one side and fastened at the other or may be fastened at both sides, in the case of split screens. The tungsten carbide or similarly hard bearing and bushing below the screen is preferably located near it, usually within 15 cm. or less and preferably within 10 cm. thereof.

In summary, the mill of this invention is of simpler, more trouble-free construction and operation, works under lower pressure in the preferred embodiments thereof, avoids having media adversely affect bearings and seals and provides additional advantages and conveniences in cleanout, salvaging of product and removal of spent media. Such advantages are obtained without the necessity for expensive or complicated structural changes in vessel construction and the invented apparatus is more efficient, less prone to break down and more readily operated and maintained.

The invention has been described with respect to various embodiments and illustrations thereof but is not to be limited to these because it is evident that one of skill in the art, with the present description and drawing before him, will be able to utilize substitutes and equivalents without departing from the invention.

What is claimed is:

1. An apparatus for continuously dispersing a particulate solid material in a liquid vehicle by means of a dispersing media which comprises a vessel having an inlet for a mixture of such particulate material and the liquid vehicle in which it is to be dispersed and an outlet for such particulate material dispersed in the liquid vehicle, an agitator for agitating the particulate material, the liquid vehicle therefor and the media to break up any agglomerates of the particulate material and to disperse such material in the liquid vehicle, said agitator including a rotatable shaft, a stationary screen in the vessel at an inner location at an end thereof and defining a volume, through which screen and into which volume the dispersion of particulate material in liquid vehicle therefor passes to exit from the vessel through the outlet thereof and through which the media cannot pass, said screen being located about the shaft, and a bearing in the vessel and upstream of the screen for holding the shaft in position while permitting the rotation thereof, said bearing having moving and stationary surfaces and a clearance, space between them which is small enough to prevent the media from entering into such clearance space, said clearance space communicating the vessel interior upstream of the screen with the volume defined by the screen.

2. An apparatus according to claim 1 wherein the vessel is substantially vertical, to the inlet is at the bottom thereof, the outlet is at the top thereof, the agitator has a substantially vertical shaft which rotates about a substantially vertical axis and the stationary screen is located inside the vessel at the top thereof.

3. An apparatus according to claim 2 wherein the vessel and the stationary screen are of vertical cylindrical shapes, the shaft of the agitator and the screen are vertical and coaxial with the vessel, the agitator shaft passes through the screen cylinder and the openings of the screen are of such size as to pass the dispersion of particulate material in liquid vehicle and bar passage of dispersing media.

4. An apparatus according to claim 2 which is a closed mill and wherein a bearing is provided where the rotatable shaft enters the vessel and means are provided at the vessel outlet or in communication therewith to maintain the pressure at said outlet and at said bearing at less than 0.2 kg./ sq. cm. gauge.

5. An apparatus according to claim 4 wherein the outlet is communicated with the atmosphere by a trough on the top thereof so that the maximum height above the vessel to which the exiting dispersion of particulate material in liquid vehicle rises is less than two meters above the vessel.

6. An apparatus according to claim 2 wherein the inlet is in a removable fitting in a side wall of the vessel at the bottom thereof, which fitting is subject to being worn about the opening thereof by repeated contact of the media with it during use and is replaceable by another such fitting after being so worn, whereby the vessel wall is protected against such wear.

7. An apparatus according to claim 6 wherein the vessel is substantially vertical, the inlet is at the bottom thereof, the outlet is at the top thereof, the agitator has a substantially vertical shaft which rotates about a substantially vertical axis and the stationary screen is located inside the vessel at the top thereof.

8. An apparatus according to claim 2 wherein the vessel has a side wall and a bottom, both of which are jacketed so that a fluid may be circulated therethrough to modify the temperature of contents of the vessel.

9. An apparatus according to claim 8 wherein the vessel is substantially vertical, the inlet is at the bottom thereof, the outlet is at the top thereof, the agitator has a substantially vertical shaft which rotates about a substantially vertical axis and the stationary screen is located inside the vessel at the top thereof.

10. An apparatus according to claim 2 wherein the vessel has a bottom containing an opening and a removable screened outlet fitting in said opening adapted to allow removal of liquid and particulate material dispersed therein and to prevent removal of media when the screened fitting is in place, to allow removal of media, particulate material and liquid when the screen is removed and to allow the passage of washing liquid therethrough and into the vessel when the screened fitting is in place.

11. An apparatus according to claim 10 wherein the vessel and the stationary screen are of vertical cylindrical shapes, and shaft of the agitator and the screen cylinder are vertical and coaxial with the vessel, the agitator shaft passes through the screen cylinder and the openings of the screen are of such size as to pass the dispersion of particulate material in liquid vehicle and bar passage of dispersing media.

12. An apparatus according to claim 2 wherein means are provided on the shaft inside the stationary screen for rotating with the shaft and lifting particulate material by contact therewith to prevent buildup of particulate material at the bottom thereof.

13. An apparatus according to claim 12 wherein the vessel and the stationary screen are of vertical cylindrical shapes, the shaft of the agitator and the screen cylinder are vertical and coaxial with the vessel, the agitator shaft passes through the screen cylinder and the openings of the screen are of such size as to pass the dispersion of particulate material in liquid vehicle and bar passage of dispersing media.

14. An apparatus for continuously dispersing a particulate solid material in a liquid vehicle by means of a dispersing media which comprises a substantially vertical vessel having an inlet at the bottom thereof for a mixture of such particulate material and the liquid vehicle in which it is to be dispersed and an outlet at the top thereof for such particulate material dispersed in the liquid vehicle, an agitator for agitating the particulate solid material, the liquid vehicle therefor and the media to break up any agglomerates of the particulate material and to disperse such material in the liquid vehicle, said agitator having a substantially vertical shaft which rotates about a substantially vertical axis, a stationary screen located inside the vessel at an inner location at the top thereof, through which the dispersion of particulate material in liquid vehicle therefor passes to exit from the vessel through the outlet thereof and through which the media does not pass annd a stationary screen at the top and at the circumference of the vessel extending below the inner screen and communicating with a discharge opening through the vessel wall so that undersized media passes through such screen and opening during washing and is thereby removable from other media in the apparatus.

15. An apparatus according to claim 14 wherein the openings in the external screen through which spent media passes during washing are at least 25% greater in area than those in the internal screen through which passes the particulate material dispersed in liquid vehicle.

16. An apparatus according to claim 14 wherein the vessel and the stationary screen are of vertical cylindrical shapes, the shaft of the agitator and the screen are vertical and coaxial with the vessel, the agitator shaft passes through the screen cylinder and the openings of the screen are of such size as to pass the dispersion of particulate material in liquid vehicle and bar passage of dispersing media.

17. An apparatus for continuously dispersing a particulate solid material in a liquid vehicle by means of a dispersing media which comprises a substantially vertical vessel having an inlet at the bottom thereof for a mixture of such particulate material and the liquid vehicle in which it is to be dispersed and an outlet at the top thereof for such particulate material dispersed in the liquid vehicle, an agitator for agitating the particulate material, the liquid vehicle thereof and the media to break up any agglomerates of the particulate material and to disperse such material in the liquid vehicle, said agitator having a substantially vertical shaft which rotates about a substantially vertical axis, a stationary screen located inside the vessel and at an inner location at the top thereof, through which the dispersion of particulate material in liquid vehicle therefor passes to exit from the vessel through the outlet thereof and through which the media does not pass and a helical spring held to the shaft inside the stationary inner screen by its spring tension for preventing buildup of particulate material at the location thereof.

18. An apparatus for continuously dispersing a particulate solid material in a liquid vehicle by means of a dispersing media which comprises a substantially vertical vessel having an inlet at the bottom thereof for a mixture of such particulate material and the liquid vehicle in which it is to be dispersed and an outlet at the top thereof for such particulate material dispersed in the liquid vehicle, an agitator for agitating the particulate solid material, the liquid vehicle therefor and the media to break up any agglomerates of the particulate material and to disperse such material in the liquid vehicle, said agitator having a substantially vertical shaft which rotates about a substantially vertical axis, a stationary screen located inside the vessel at an inner location at the top thereof, through which the dispersion of particulate material in liquid vehicle therefor passes to exit from the vessel through the outlet thereof and through which the media does not pass, a bearing of hard material on the substantially vertical shaft at a location below the stationary screen and near said screen, a screen holder for maintaining the stationary screen in position, said screen holder having a bushing holder connected to it, which bushing holder holds a bushing of hard material so that a surface thereof is in bearing-bushing contact with a surface of the bearing, with a clearance space between the bushing and bearing which is small enough to prevent media from entering into such clearance.

19. An apparatus according to claim 18 wherein the contact surfaces of both the bearing and bushing are of tungsten carbide.

20. An apparatus according to claim 18 wherein the vessel and the stationary screen are of vertical cylindrical shapes, the shaft of the agitator and the screen cylinder are vertical and coaxial with the vessel, the agitator shaft passes through the screen cylinder and the openings of the screen are of such size as to pass the dispersion of particulate material in liquid vehicle and bar passage of dispersing media.

21. An apparatus for continuously dispersing a particulate solid material in a liquid vehicle by means of a dispersing media which comprises a vertical cylindrical vessel having an inlet at the bottom thereof for a mixture of such particulate material and a liquid vehicle in which it is to be dispersed and an outlet at the top thereof for such particulate material dispersed in the liquid vehicle, an agitator for agitating the particulate solid material, the liquid vehicle therefor and the media to break up any agglomerates of the particulate material and to disperse such material in the liquid vehicle, said agitator including a vertical rotatable shaft, a vertical cylindrical stationary screen in the vessel at an inner location at an end thereof and defining a volume, the screen cylinder and the agitator shaft being coaxial with the vessel and the agitator shaft passing through the screen cylinder, the screen having openings of such a size as to pass the dispersion of particulate material in liquid vehicle and bar passage of dispersing media, the vessel cylindrical side wall and bottom both being jacketed so that a fluid may be circulated therethrough to modify the temperature of the contents of the vessel, the vessel bottom containing an opening and a removable screen outlet fitting inside the opening adapted to allow removal of liquid and particulate material dispersed therein and to prevent removal of the media when the screened fitting is in place, to allow removal of media, particulate material and liquid when the screen is removed and to allow the passage of washing liquid therethrough and into the vessel when the screened fitting is in place, a stationary screen at the circumference of the vessel extending below the inner screen and communicating with the discharge opening through the vessel wall so that undersized media passes through such screen and such discharge opening during washing and is thereby removed from the media in the apparatus, means on the shaft inside the stationary inner screen for preventing buildup of particulate material at said location and, at a location below the stationary inner screen and near said screen, on the vertical shaft, a bearing of hard material, and a screen holder for maintaining the stationary inner screen in position, said screen holder having a bushing holder connected to it and said bushing holder holding a bushing of hard material so that the surface thereof is in bearing-bushing contact with the surface of the bearing, with the clearance between the bushing and the bearing being small enough to prevent the media from entering into such clearance space.

22. An apparatus according to claim 21 wherein the means on the shaft inside the stationary inner screen for preventing particulate material buildup is a helical spring held to the shaft by its spring tension and the bearing and bushing are of tungsten carbide.

* * * * *